US007434747B2

(12) United States Patent
Helzer et al.

(10) Patent No.: US 7,434,747 B2
(45) Date of Patent: Oct. 14, 2008

(54) INTERNAL PARTICULATE PROTECTIVE OBSTRUCTION FOR SPRINKLERS

(75) Inventors: Bradley D. Helzer, Ontario (CA); Jonathan Yeh, Chino, CA (US)

(73) Assignee: Rain Bird Corporation, Azusa, CA (US)

( * ) Notice: Subject to any disclaimer, the term of this patent is extended or adjusted under 35 U.S.C. 154(b) by 63 days.

(21) Appl. No.: 10/979,671

(22) Filed: Nov. 2, 2004

(65) Prior Publication Data

US 2006/0091236 A1 May 4, 2006

(51) Int. Cl.
*B05B 3/04* (2006.01)

(52) U.S. Cl. ..... 239/240; 239/205; 239/570; 239/571

(58) Field of Classification Search ..... 239/237, 239/240, 241, 242, 263.3, 264, 576, 577, 239/571, 541, 456, 200–206, 570
See application file for complete search history.

(56) References Cited

U.S. PATENT DOCUMENTS 3,570,447 A * 3/1971 Basseches et al. ..... 116/112
3,733,030 A * 5/1973 Carstenson ..... 239/205
4,026,471 A * 5/1977 Hunter ..... 239/206
4,340,179 A * 7/1982 Knapp ..... 239/310
4,681,260 A * 7/1987 Cochran ..... 239/240
4,796,804 A * 1/1989 Weiss ..... 239/1
5,009,368 A * 4/1991 Streck et al. ..... 239/70
6,502,764 B2 1/2003 Walker

* cited by examiner

*Primary Examiner*—Christopher S Kim
(74) *Attorney, Agent, or Firm*—Fitch, Even, Tabin & Flannery

(57) ABSTRACT

A sprinkler that restricts foreign particulate matter from interfering with and/or damaging the operating components of a sprinkler is disclosed. The sprinkler may be a pop-up sprinkler such that the outlet or nozzle is not in a fixed position and is moved from a position above the ground to a position generally below or flush with the ground. To prevent particulate matter from entering, such as through the nozzle or outlet, when the flow of water is shut off, the sprinkler may include a protective member located within the sprinkler head to prevent the particulate matter from have an undesirable effect. The protective member forms a one-way obstruction that permits flow to the nozzle and obstructs flow back into the sprinkler such that particulate matter in the water beyond the protective member is restricted from coming in contact with the internal operating components of the sprinkler. The protective member may be a resiliently deformable flap or a hinged flap.

3 Claims, 4 Drawing Sheets

INTERNAL PARTICULATE PROTECTIVE OBSTRUCTION FOR SPRINKLERS

FIELD OF THE INVENTION

The invention relates to a sprinkler and, in particular, to an internal particulate protective obstruction to restrict the entry of foreign matter into a sprinkler.

BACKGROUND OF THE INVENTION

Sprinklers are widely used in both commercial and residential settings, for instance, to control the irrigation of crops or to maintain the healthy appearance of lawns. Most often, sprinklers are used in outdoor settings, such as in agricultural or other fields, on golf courses, and on residential lawns. As a result of being in an uncontrolled, outdoor environment, sprinklers are exposed to airborne particles, such as pollen, seeds, and bugs, as well as other loose debris, such as dirt and tree bark.

By design, sprinklers have openings to allow water from a pressurized source to be distributed to their surrounding areas. Therefore, it is possible for foreign contaminants to enter the sprinkler housing through the spray head nozzle outlet, especially when water is not flowing. Pop-up sprinklers, in particular, are prone to the entry of foreign contaminants into the sprinkler mechanism.

Pop-up sprinklers are especially susceptible to the entry of foreign contaminants due to the nature of their operation. In a pop-up sprinkler, the spray head nozzle outlet is mounted in a movable casing that travels between a position below the surface of the ground and a position above the ground. When the sprinkler is turned off, the spray head may be retracted below the surface of the ground so that the ground is generally flush with or close to the top of the spray head. When the sprinkler is in operation, the spray head moves to a position above the ground to distribute water to the surrounding areas. As a result of this motion, dirt and other particles around the sprinkler housing may become disturbed, making it more likely that these particles will gain entry into the sprinkler.

Once the foreign contaminants are inside the sprinkler, they may disrupt its operation. For example, many sprinklers have a rotary drive mechanism. Particles of dirt may prevent the rotary drive mechanism of a sprinkler from properly rotating the spray head, or may even damage the drive mechanism. Such a malfunction or damage caused by the entry of foreign contaminants would mostly likely require the sprinkler to be completely removed from the ground and either replaced or repaired, costing time and energy and potentially disrupting the entire irrigation scheme of the area being watered.

Accordingly, there is a need for a sprinkler with improved resistance to the entry of foreign contaminants or particulate matter.

DESCRIPTION OF THE PREFERRED EMBODIMENTS

Figure 1:
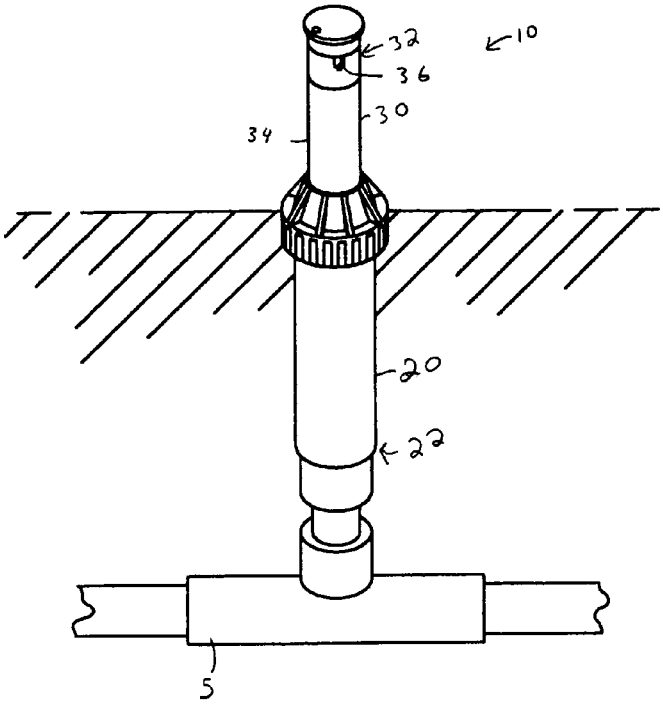
FIG. 1 is a perspective view of a rotary drive pop-up sprinkler in an extended use position.

FIG. 1 shows a representative pop-up sprinkler 10 in an operative position for distributing water. The pop-up sprinkler 10 includes a tubular, fixed housing, or sprinkler case 20, that is telescopically connected to a tubular, movable housing 30 such that the housing 30 may move from an operative position to an inoperative position. In the operative position, the housing 30 extends from the case 20 to position a spray head 32 is above the ground surface to distribute water to the surrounding area. In the inoperative position, the housing 30 retracts into the sprinkler case 20 such that the spray head 32 is generally flush with or beneath the surface of the ground.

The sprinkler case 20 has an inlet connection 22 for connecting to a pressurized water supply line 5 that delivers water to the sprinkler 10. The sprinkler 10 may include a filter or screen 12 (FIG. 2) located near the inlet connection 22 and in the path of the entering water to screen out foreign particulate matter from the water source. The water passes through the sprinkler 10 and is emitted from the spray head 32.

The housing 30 includes a base portion 34, and the spray head 32 is disposed at the distal end of the base portion 34. The spray head 32 includes a nozzle outlet 36 from which water is projected out of the sprinkler 10. When the sprinkler 10 is shut off so that substantially no water is emitted, the movable housing 30 retracts to the inoperative position. In the inoperative position, the nozzle outlet 36 is retracted into the sprinkler case 20 to close off the sprinkler 10. However, in some instances, loose debris, bugs, or proximal plants may enter the nozzle outlet 36, such as when it moves between the inoperative and operative positions, and, as a result, the nozzle outlet 36 does not retract completely to close the interior of the sprinkler 10, which may allow a seepage of groundwater and contaminants.

Figure 2:
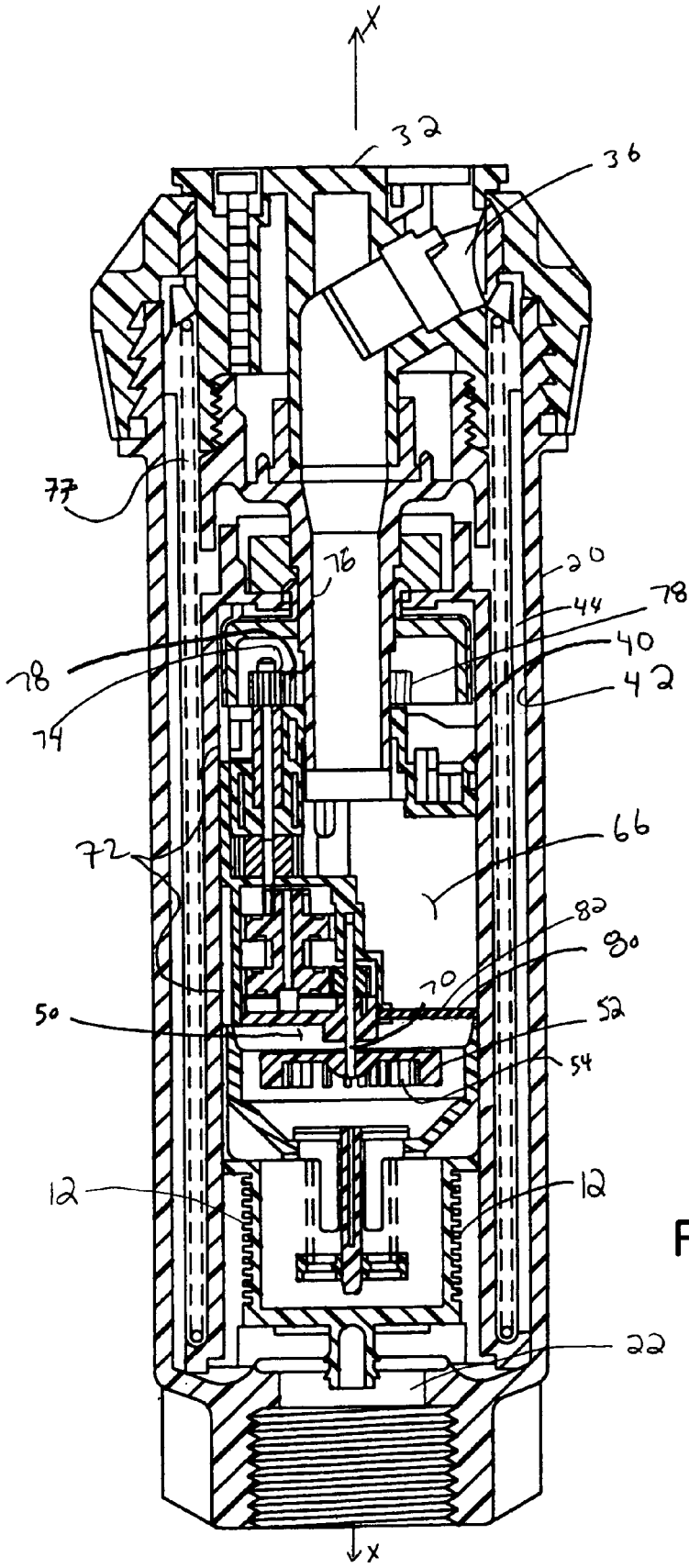
FIG. 2 is a fragmentary cross-sectional view of the sprinkler of FIG. 1 in a retracted position showing a protective member in a substantially closed position.

Prior to the sprinkler 10 being activated to distribute water to the surrounding area, the sprinkler 10 is in the retracted inoperative position, as is shown in FIG. 2, wherein the housing 30 and its internal components are located within the sprinkler case 20. Once the water is turned on and the sprinkler 10 is activated for distributing water, the water pressure from the inlet 22 forces the movable housing 30 upwards so that it extends from the sprinkler case 20, and water can emit from the nozzle outlet 36. The movable housing 30 has an exterior surface 40 generally directed towards an interior surface 42 of the sprinkler case 20. The surfaces 40, 42 generally include cooperating structure that permits the movable housing 30 to move generally along the central longitudinal axis X of the sprinkler case 20, while generally preventing relative rotation between the sprinkler case 20 and the movable housing 30. Preferably, the cooperating structure includes a plurality of ribs 44 radially located on the interior surface 42 of the sprinkler case 20, and recesses (not shown) equal or greater than the number of ribs 44 and located on the exterior surface 40 of the movable housing 30. The cooperating structures, such as the ribs 44 and recesses, guide the relative longitudinal movement between the housing 30 and the sprinkler case 20. The recesses may be formed on a lower portion, such as a ratchet (not shown), of the movable housing 30.

As the water passes through the movable housing 30, it drives a rotary drive mechanism 50 disposed within the movable housing 30. The drive mechanism 50 utilizes the force of the water to rotate the spray head 32 relative to the movable housing 30 and the sprinkler case 20 so that water projected from the spray head 32 is distributed over a predetermined arcuate range, such as a full or partial circular area.

Figure 3:
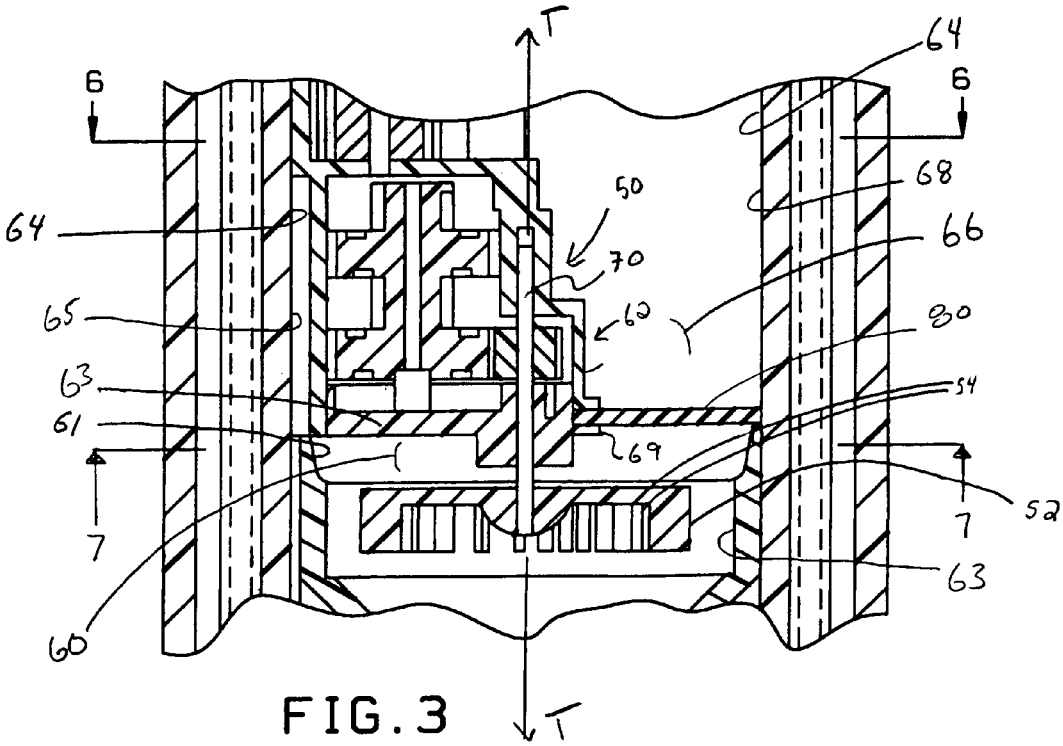
FIG. 3 is a partial cross-sectional view of the sprinkler of FIG. 2.

Water entering the rotary drive mechanism 50 located at a lowermost portion of the movable housing 30 generally strikes a turbine 52, including turbine blades 54, as illustrated in FIG. 3. The turbine 52 has a generally disc-like configuration with openings (not shown) to permit water to pass through the turbine 52. The blades 54 are located radially about a central axis T of the turbine 52 and adjacent the openings in the turbine 52 so that a portion of the kinetic energy of the water is imparted to the blades 54 when the water strikes there against as the water passes through the turbine 52.

A main water channel 66 is located within the movable housing 30 and above the turbine 52. A lower cavity 60 defined in part by a bottom plate 63 of a drive housing 62 and by a turbine draft surface 61 of the movable housing 30 is located in part below the drive housing 67 and in part below the channel 66. The channel 66 is generally located between a portion 68 of an interior surface 64 of the movable housing 30 and the drive housing 62. The drive housing 62 abuts another portion 65 of the interior surface 64 of the movable housing 30 and includes the bottom plate 63. Once the water passes through the turbine 52, it flows either directly through the lower cavity and into the channel 66 or into the portion of the lower cavity 60 under the bottom plate 63 of the drive housing 62. The bottom plate 63 forces the water to a channel side 69 of the lower cavity 60 for passage into the channel 66. The water generally follows the channel 66 to the nozzle outlet 36 for distribution or emission from the sprinkler 10.

With reference to FIG. 2, the turbine 52 is fixed at its central axis T to a drive shaft axle 70 such that rotation of the turbine 52 causes rotation of the drive shaft 70. The water force on the turbine blades 54 is transmitted through the turbine 52 and to the drive shaft 70. The drive shaft 70, in turn, extends through the bottom plate 63 of the drive housing 62 and is in geared cooperation with a drive mechanism 72 which is, in turn, connected to the spray head 32 by an output gear 74. The drive mechanism 72 includes a series of gears ratioed to reduce the input rotational velocity of the turbine 52 and drive shaft 70 to a desired output rotational velocity for the spray head 32. A head pipe 76 depends from the spray head 32 into the channel 66. The channel 66 directs the water through the sprinkler 10 and into the head pipe 76. The head pipe 76 has external gear teeth 78 that mate with the gear teeth of the output gear 74 such that the drive mechanism 72 transmits rotational drive to the head pipe 76. Thus, rotation of the drive mechanism 72 rotates the head pipe 76 which, in turn, rotates the spray head 32 to which the head pipe 76 is connected. The turbine 52, drive shaft 70, drive mechanism 72, head pipe 76, and spray head 32, among other components, may be lubricated, such as with a grease, to reduce friction.

When the sprinkler 10 is emitting water, foreign particulate matter is generally prevented from entering the sprinkler 10. That is, the force of exiting water prevents matter from entering the nozzle outlet 36, and the filter or screen 12 prevents matter from entering into the sprinkler 10 through the inlet 22 or water source. However, when the sprinkler 10 is shut off, foreign matter may enter.

More specifically, when the sprinkler 10 is shut off, the movable housing 30 is biased by a spring 77 to retract into the sprinkler case 20. In the event the sprinkler 10 operates as intended, the movable housing 30 retracts so that the nozzle outlet 36 recedes into the sprinkler case 20 at a position close to or flush with the ground, yet the nozzle outlet 36 is not protected from the elements until it is located within the sprinkler case 20. Further, the movable housing 30 may occasionally not operate as intended, leaving the nozzle outlet 36 exposed to the elements. In either event, it has been found that with prior sprinklers, when they are shut off, water will drift downward through the main water channel and through the turbine, which has been found to enable entry of foreign matter, such as through a vacuum being created. As a result, the foreign matter carried by the water may infiltrate into the internal components, such as the drive shaft turbine and gearing of the drive mechanism, and cause them to malfunction or become damaged. Moreover, the foreign matter will become stuck in any lubricant, such as grease, and cause excessive wear.

Figure 4:
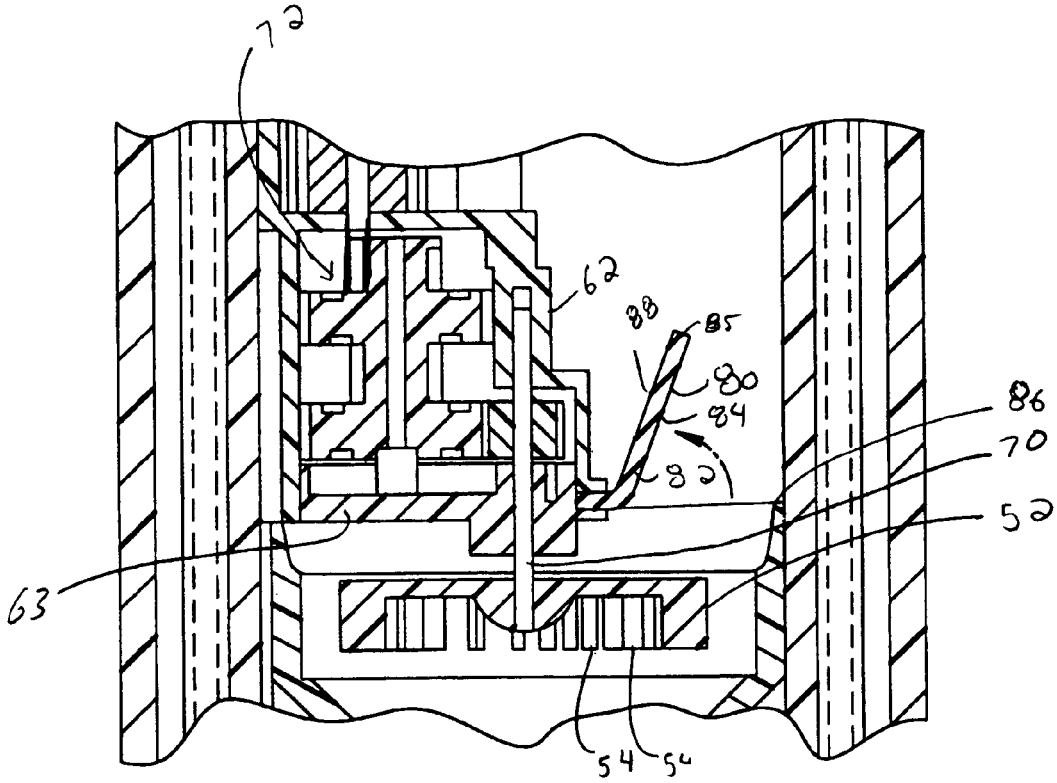
FIG. 4 is a fragmentary cross-sectional view of the sprinkler of FIG. 2 showing a protective member in a substantially open position.

In order to reduce the potential for foreign matter to enter the sprinkler 10 through the nozzle outlet 36, a protective member 80 is disposed to operate in the channel 66 of the movable housing 30 between the main water channel 66 and the lower cavity 60. The protective member 80 may be a screen (not shown) or other structure that permits the passage of fluid, while generally restricting or preventing the passage of particulate contaminants. Preferably, the protective member 80 is in the form of a movable barrier. The barrier 80 has a generally closed or obstructing position (FIG. 3) that generally prevents the backflow of water and foreign matter toward the water source, and has an open position (FIG. 4) in which the barrier 80 is moved generally out of the stream of water as it passes through the sprinkler 10 from the lower cavity 60 to the main water channel 66. The force of the passing water causes the barrier 80 to move from the closed position to the open position, as depicted in FIG. 4.

In the preferred embodiment, the movable barrier 80 is positioned to operated between the drive housing 62 and the interior surface 64 of the movable housing 30 adjacent the lower cavity 60. When the water is shut off, the movable barrier 80 shifts from the generally open position to the generally closed position, in which it extends between the drive housing 62 and the interior surface 64 to obstruct flow from the main water channel 66 to the lower cavity 60. This movement can be effected in a number of ways, such as with a bias mechanism, resilient material, the weight of the barrier 80, or a combination thereof. Although there may be a slight delay from when the water is shut off and the movable barrier 80 reaching the closed position, foreign matter entering the nozzle outlet 36 when the water is shut off in the preferred embodiment will not reach the barrier 80 before the barrier 80 is able to move to the closed position because of the distance from the nozzle 346 to the barrier 80.

Figure 5:
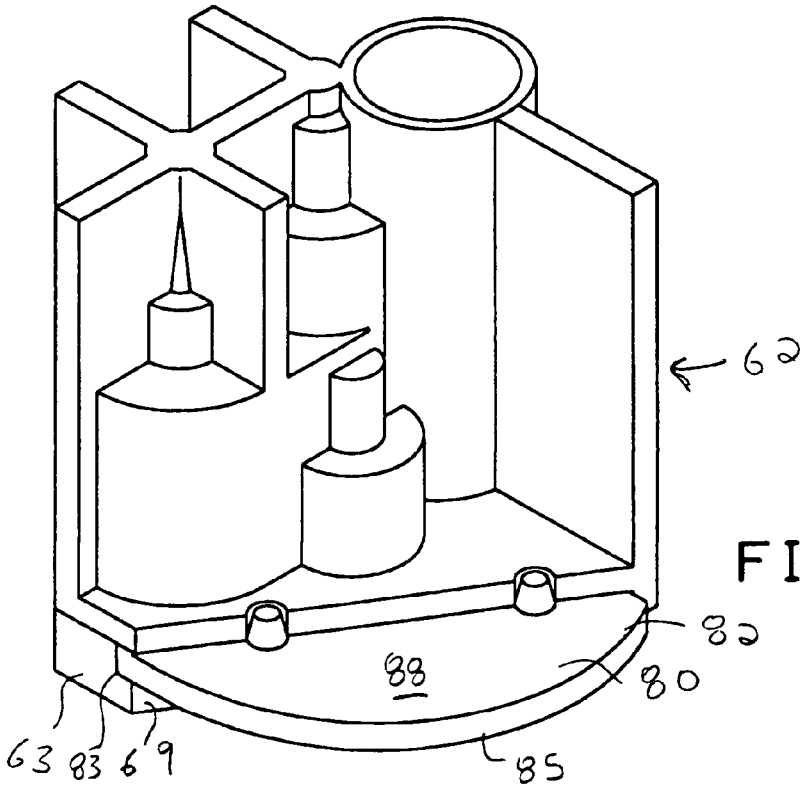
FIG. 5 is a perspective view of a drive housing and the protective member of FIG. 3 in a substantially closed position.
Figure 6:
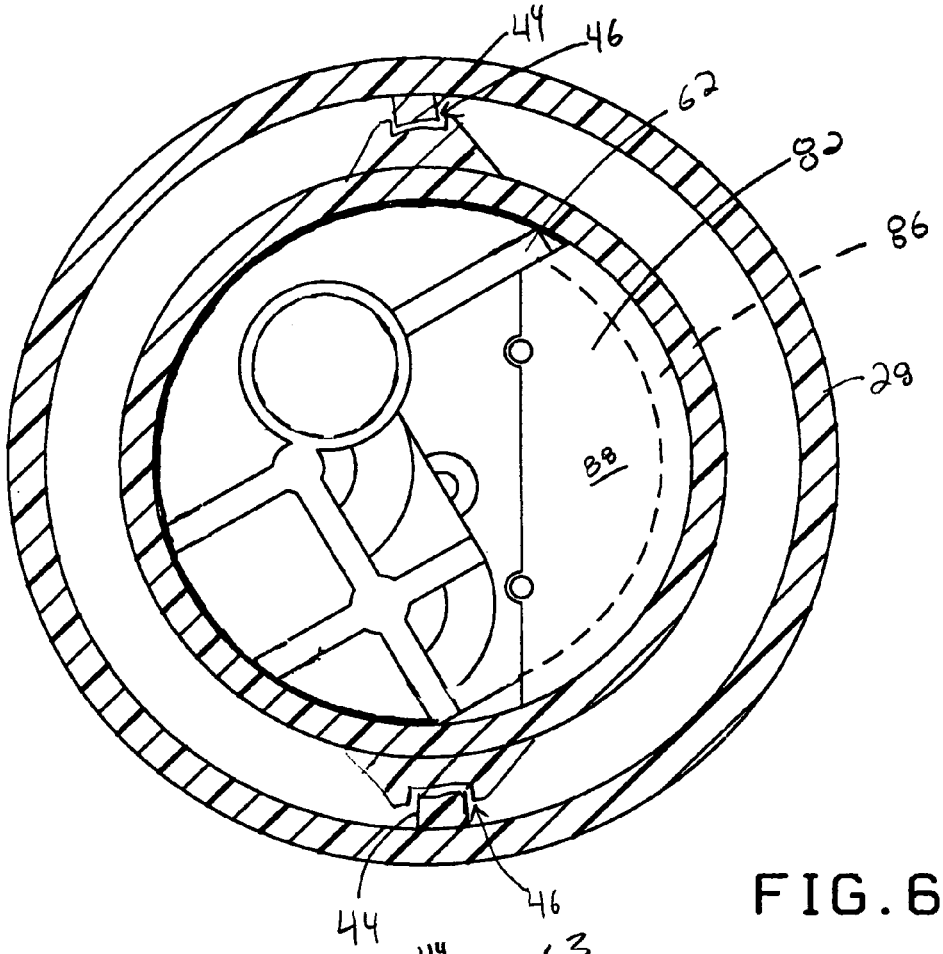
FIG. 6 is a cross-sectional view of the sprinkler taken through line 6-6 of FIG. 3 with the protective member in a substantially closed position.
Figure 7:
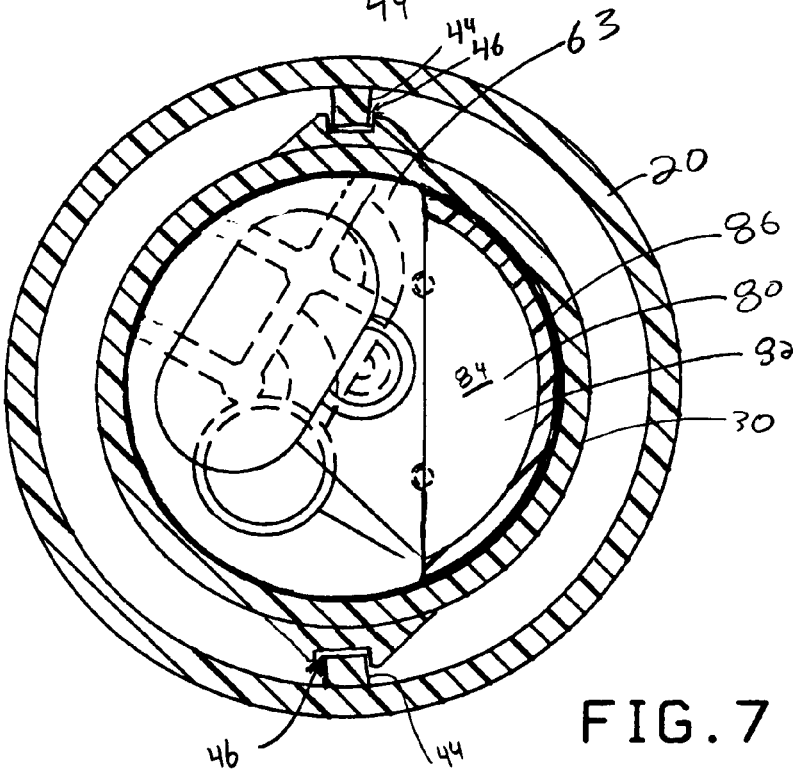
FIG. 7 is a cross-sectional view of the sprinkler taken through line 7-7 of FIG. 3 with the protective member in a substantially closed position.

With reference to FIG. 5, the preferred barrier 80 has a flap-like construction 82 with a first edge 83 and a free edge 85. The first edge 83 is anchored to the drive housing 62. The flap 82 extends from the channel side 69 to the interior surface 64 of the movable housing 30. With reference to FIGS. 3-5, the preferred flap 82 is a unitary structure formed of a resiliently deformable material. The first edge 83 may be clamped between the bottom plate 63 and the drive housing 62, as can be seen in FIG. 3. The force of water applied to a bottom side 84 of the flap 82 will cause the flap 82 to be folded upward into the channel 66 so that water may pass by the flap 82 and into the channel 66. When the water is shut off, the natural resilience of the flap 82 will cause the flap 82 to return to the generally closed position. In the generally closed position, the free edge 85 rests against the interior surface 64 of the movable housing 30 such that water backflow, as well as any particulate matter therein, is generally restricted from passing into the lower cavity 60. The flap may have any other structure, such as a hinge (not shown), or a bias element (not shown), such as a spring, that enables the flap 82 to act as a one-way valve type obstruction for particulate matter in the water flow.

The channel 66 preferably includes an internal shoulder 86 on which the free edge 85 of the flap 82 rests when the flap 82 is in the generally closed position. The shoulder 86 ensures that the flap 82 does not deform or move downward, which otherwise may allow foreign particulate matter to pass by. Alternatively or in addition, the flap 82 may be over-sized. The flap 82, when laid flat, traverses across the channel 66 and may have an area greater than the transverse cross-section of the channel 66. In this form, the over-sizing of the flap 82 helps prevent foreign particulate matter from passing by the flap 82. When the flap 82 moves to the generally closed position, it can bunch against the interior surface 64 and/or the shoulder 86 of the movable housing 30. In any case, the flap 82 may have either a uniform thickness or a varying thickness. For example, the over-sized form of the flap 82 benefits from thinning towards the free end 85 because the described bunching is promoted by a more compliant structure.

With the embodiments described above, when the flap 82 is in the substantially closed position, foreign particulate matter that may enter the sprinkler 10 from the exterior is restricted or obstructed from entering the lower cavity 60, and thus encountering the turbine 52, the drive shaft 70, the drive mechanism 72, and other moving parts of the sprinkler 10. Any such matter or debris that enters the sprinkler 10 falls onto a top surface 88 of the flap 82. When the sprinkler 10 is activated and water forces the flap 82 to move to the substantially open position, the foreign contaminants or matter resting on the top surface 88 are generally flushed out of the sprinkler 10 by the water flow through the channel 66 and out of the nozzle 30.

While the invention has been described with respect to specific examples, including presently preferred modes of carrying out the invention, those skilled in the art will appreciate that there are numerous variations and permutations of the above described systems and techniques that fall within the spirit and scope of the invention as set forth in the appended claims.

What is claimed is:

1. A sprinkler comprising:

an inlet and an outlet for fluid communication with a pressurized water source;

a body interconnecting the inlet and the outlet, and the body defining at least in part a main fluid channel in fluid communication with the inlet and the outlet;

a turbine disposed between the inlet and the outlet and being configured so that contact between the turbine and fluid flow causes rotation of the turbine;

a drive mechanism for rotating the outlet;

a drive housing being located in the body for covering a portion of the drive mechanism, the drive housing defining at least in part the main fluid channel; and a flap positioned in the main fluid channel along at least a portion of the drive housing, the flap having an open position permitting fluid flow from the inlet to the outlet and being directly moved to the open position by the fluid flow, and a closed position wherein the flap traverses across the main channel from the drive housing to the body to restrict particulate entering the outlet from encountering the turbine when the pressurized fluid flow is shut off to the sprinkler, and the flap being naturally biased to move to the closed position when the fluid flow is shut off to the sprinkler.

2. The sprinkler of claim 1, wherein the drive mechanism generally extends parallel to a portion of the main channel and down stream of the flap.

3. The sprinkler of claim 1 further comprising an accessway into the interior of the drive housing, a shaft extending through the accessway and having a connection to the turbine and a connection to the drive mechanism such that rotation of the turbine drives the drive mechanism for rotating the outlet, and wherein access from the passageway and to the connection between the shaft and drive mechanism is through the accessway, and a plate defining the accessway, and wherein the shaft extends through the the accessway, and wherein the flap is a flexible element having a fixed end connected to the plate and a free end disposed outwardly from the plate.

* * * * *